US007591260B1

(12) United States Patent
Mu

(10) Patent No.: US 7,591,260 B1
(45) Date of Patent: Sep. 22, 2009

(54) PAINTBALL HOPPER

(76) Inventor: Richard Mu, 1210 Villard St., Eugene, OR (US) 97403

( * ) Notice: Subject to any disclaimer, the term of this patent is extended or adjusted under 35 U.S.C. 154(b) by 426 days.

(21) Appl. No.: 11/305,514

(22) Filed: Dec. 15, 2005

(51) Int. Cl.
*F41B 11/02* (2006.01)

(52) U.S. Cl. ..... 124/51.1

(58) Field of Classification Search ..... 124/51.1; 221/203, 277, 258; 222/333, 410
See application file for complete search history.

(56) References Cited

U.S. PATENT DOCUMENTS 5,282,454 A 2/1994 Bell et al.
6,109,252 A * 8/2000 Stevens ..... 124/51.1
6,213,110 B1 4/2001 Christopher et al.
6,481,432 B2 11/2002 Rushton et al.
6,502,567 B1 1/2003 Christopher et al.
6,701,907 B2 3/2004 Christopher et al.
6,792,933 B2 9/2004 Christopher et al.
6,889,680 B2 5/2005 Christopher et al.

* cited by examiner

*Primary Examiner*—John Ricci
(74) *Attorney, Agent, or Firm*—Timothy E. Siegel Patent Law, PLLC

(57) ABSTRACT

A paintball hopper, comprising, a container defining a bottom paintball guide and a paintball moving assembly, adapted to move paintballs in a path determined by the bottom paintball guide. In addition a chute leading from the paintball guide is so disposed that paintballs may enter the chute from the guide without undergoing a substantial change in direction.

13 Claims, 2 Drawing Sheets

PAINTBALL HOPPER

BACKGROUND OF THE INVENTION

Paintball guns, available now for over 20 years, have become an increasingly popular part of the array of recreational options available to those seeking a release from the pressures of the modern world. A typical paintball gun shoots out a stream of balls as long as the trigger pressure is maintained and balls are available. The balls, too bulky to store in the gun itself, are kept in a hopper atop the gun and fed into the gun by the hopper.

Although there has been a desire to have gun/hopper combinations that can fire paintballs at a rate faster than the currently available 18 balls per second, it is true that a very fast rate would cause such a rapid depletion that those having a paintball competition would have to refill their hoppers constantly. Competitive paintball teams, in particular, could make use of gun/hopper combinations that operated in some optimized range, currently unavailable.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention takes the form of a paintball hopper, comprising, a container defining a bottom paintball guide and a paintball moving assembly, adapted to move paintballs in a path determined by the bottom paintball guide. In addition a chute leading from the paintball guide is so disposed that paintballs may enter the chute from the guide without undergoing a substantial change in direction.

In a second separate aspect, the present invention takes the form of a paintball hopper, comprising means for containing paintballs, the means having a bottom portion. Also, guide means at the bottom portion are adapted to permit movement of the paintballs along a set path. Additionally, chute means extending from the track means are disposed so that the paintballs may exit guide means into the chute means without a change in direction.

In a third separate aspect, the present invention takes the form of a paintball hopper, comprising a container having a bottom paintball well defined by an inwardly-facing surface that is substantially circular for an arc of about 270°. A rotatable element is adapted to push paintballs about the paintball well. Also, a chute leads from the paintball well. Moreover, the well-defining inwardly facing surface curves inwardly towards its top, thereby protecting paintballs in the well from interfering contact with paintballs above the well.

In a fourth separate aspect, the present invention takes the form of a paintball hopper, comprising a container having a bottom paintball well defined by an inwardly-facing surface that is substantially circular for an arc of about 270°. A rotatable element is adapted to push paintballs about the paintball well. Also, a chute leads from the paintball well. In greater detail, the rotatable element includes arms for pushing the paintballs about the well and radial spacers for urging the paintballs toward the radial exterior of the well.

In a fifth separate aspect, the present invention may take the form of a paintball hopper, comprising a container defining a bottom paintball well having an inwardly-facing surface that is substantially circular for an arc of about 270°. In addition, a rotatable element is adapted to push paintballs about the paintball well. Also, a chute leads from the paintball well and is, in part, defined by an opening in the inwardly facing surface. The inwardly facing surface is flattened, relative to its generally circular shape, on one side of the chute.

In addition to the exemplary aspects and embodiments described above, further aspects and embodiments will become apparent by reference to the drawings and by study of the following detailed descriptions.

Figure 1:
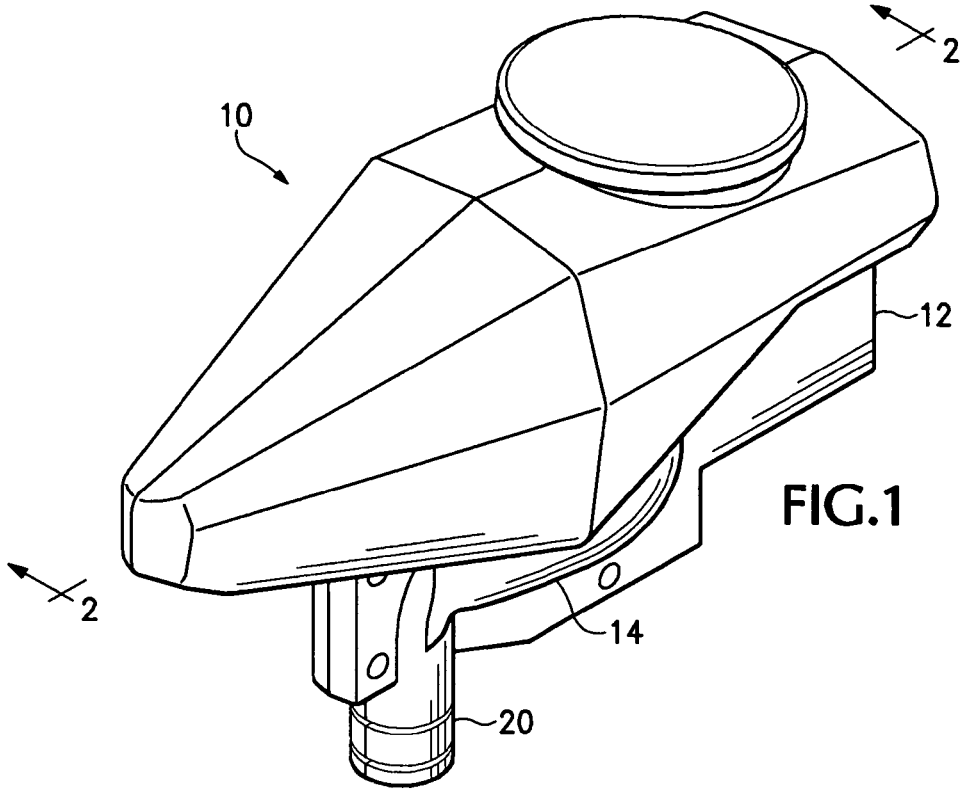
FIG. 1 is a perspective view of a paintball hopper according to the present invention.

Exemplary embodiments are illustrated in referenced figures of the drawings. It is intended that the embodiments and figures disclosed herein are to be considered illustrative rather than restrictive.

DETAILED DESCRIPTION OF THE PREFERRED EMBODIMENT(S)

A paintball hopper 10 includes a top container portion 12 and a bottom paintball guide 14. In a preferred embodiment, as shown, the paintball guide 14 is in the form of a bottom well 14 defined by a sidewall 16 (FIG. 2) having an inwardly facing surface that is circular for an arc of about 270°. As shown, bottom well 14 is positioned at a slant, with its front portion (from which the paintballs 18 exit down an exit chute 20) further down than its rear portion, to help urge the paintballs along toward the exit chute 20. A ball moving assembly includes a rotating turnstile 22 with flexible arms 24, driven by an electric motor (not shown). Turnstile 22 also includes a set of radial spacers 26 adapted to urge balls 18 toward the outside of well 14, so that balls do not jam together in the well 14. In addition, sidewall 16 curves inwardly as it extends upwardly to form a protective partial overhang 28 (FIG. 2) for well 14. Overhang 28 acts to reduce the interference of paintballs 18 in the container portion 12 from pressing downwardly and impeding the progress of paintballs 18 that are in well 14, particularly as they approach the chute 20.

A projection 40, creates a flattened portion of the inwardly facing surface of sidewall 16. Projection 40 helps to prevent the balls stored above the well 14 from interfering with the progress of balls in well 14.

Figure 2:
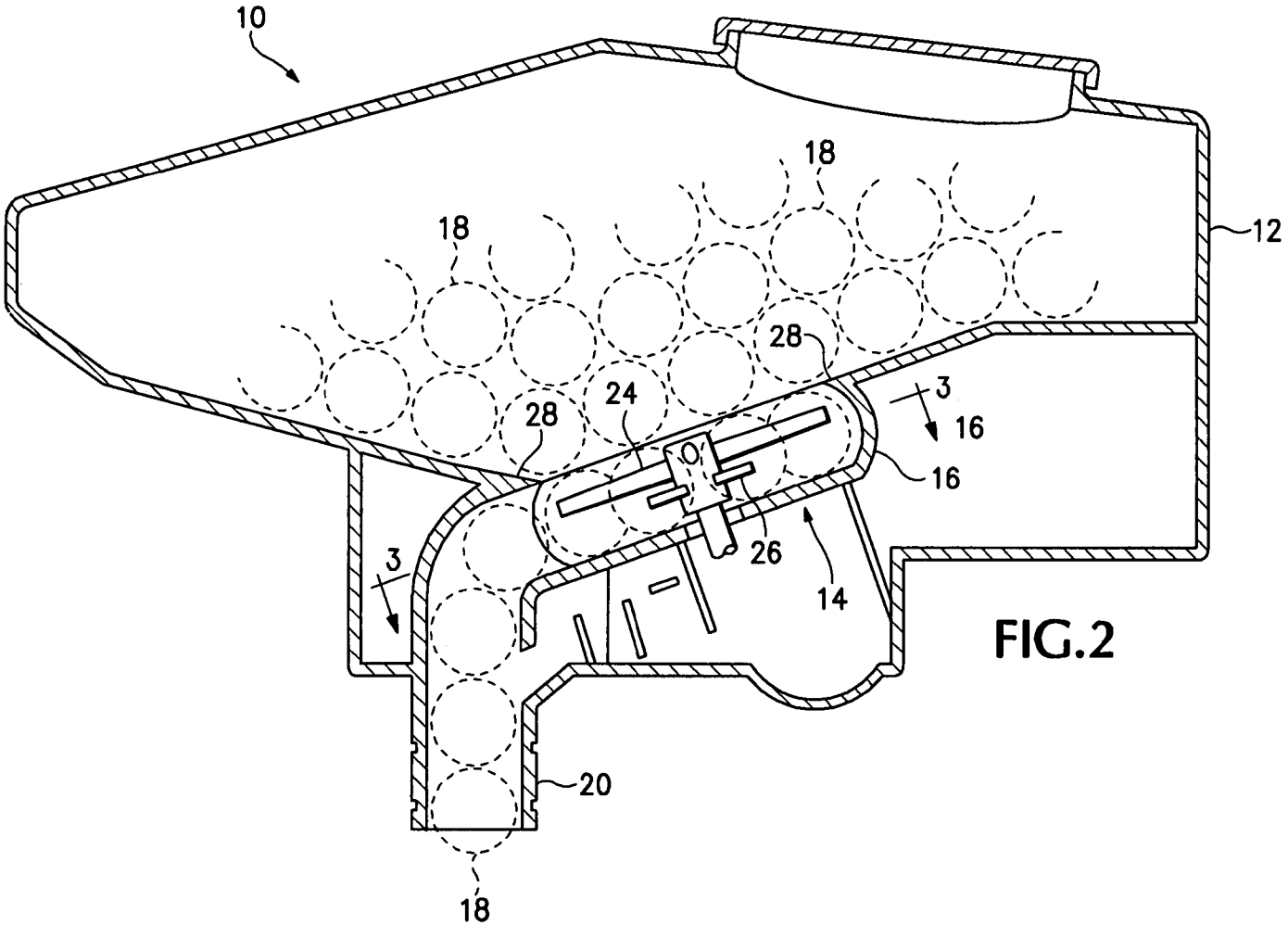
FIG. 2 is a side sectional view of the paintball hopper of FIG. 1.

The opening to chute 20 is partially defined by a portion of the inwardly facing surface of sidewall 16 that has a relaxed curvature relative to the portion that extends in a substantially circular arc. Accordingly the portion with relaxed curvature does not join the projection 40 to form a closed shape, as shown in FIG. 2. The gap thus created between the portion with relaxed curvature and projection 40 forms the opening to the chute 20. Because the inwardly facing surface of sidewall 16 changes direction only gradually, a ball progressing along this surface does not undergo a sudden change in direction when entering the chute 20 from the well 14.

Figure 3:
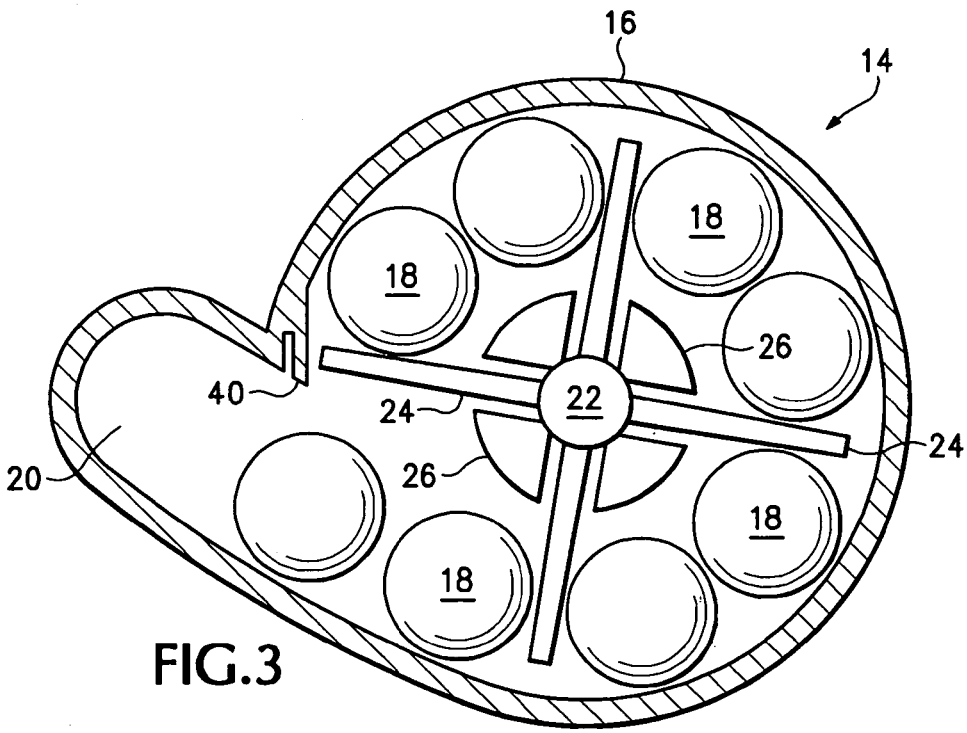
FIG. 3 is a partial top sectional view of the paintball hopper of FIG. 1.

Referring to FIG. 3, skilled persons will readily recognize that the inwardly facing surface of sidewall 16, in the plane of FIG. 3, defines a tangent line at every point along its surface. Each of these tangent lines defines a tangent direction. FIG. 3 shows that tangent direction vanes continuously along the path a paintball travels, along sidewall 16, thereby having no discontinuities. Stated in a less formal manner, there are no kinks in surface 16, in the path a paintball travels. It should be noted that projection 40 is not encountered by a paintball as it travels around surface 16.

Because the paintballs 18 do not change direction as they leave the guide 14 for the chute 20, there is no need to decelerate in one direction component and to accelerate in another direction component in order to maintain the same speed. Accordingly the paintballs 18 are able to move more quickly from guide or well 14 to chute 20. In addition the better organization of the balls in the well, due to partial overhang 28 and the radial spacers 26, acts to increase the rate at which balls go down chute 20. Ball per second rates in excess of 20 balls per second have been achieved. Moreover, an optimum range of paintball hopper ball delivery of between 20 and 30 balls per second has been discovered. At this rate, a strong stream of balls is produced, but the hopper is not emptied too rapidly.

In one preferred embodiment hopper 10 is made of pieces of injection molded polymer that are fastened together. Container portion 12 may be made of two pieces of transparent or translucent polymer that are riveted or screwed together. The well 14 may be a separate piece that is fit into the pieces that form container portion 12.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A paintball hopper, comprising:

(a) a container having a bottom and defining a bottom paintball guide in form of a well at said bottom of said container, being defined by an inwardly facing surface that is substantially circular over an arc of about three-quarters of a circle, said inwardly facing surface thereby defining a curve, which at every point defines a tangent direction;

(b) a paintball moving assembly, adapted to move paintballs in a path determined by said bottom paintball guide;

(c) a chute leading from said paintball guide and being so disposed that paintballs may reach said chute from said guide without undergoing a substantial change in direction; and (d) wherein said inwardly facing surface that defines said well includes a portion of relaxed curvature, and wherein said portion of relaxed curvature does not rejoin said substantially circular portion to form a closed shape, but rather partially defines an opening in said well-defining inwardly facing surface, which is the entrance to said chute, and wherein said tangent direction of said curve of said inwardly facing surface, over a path of a paintball traveling along said inwardly facing surface, varies over said path, and undergoes no discontinuities over said path.

2. The paintball hopper of claim 1 wherein said portion of relaxed curvature more specifically forms a portion of said paintball guide that is straight and is joined tangentially to said substantially circular arc.

3. The paintball hopper of claim 1 wherein said inwardly facing surface curves vertically inwardly to form a concave surface, thereby forming a partial overhang that protects balls in said well from being impeded by interference from balls above said well.

4. The paintball hopper of claim 1, wherein said paintball moving assembly is a turnstile rotated by a motor assembly.

5. The paintball hopper of claim 4, wherein said turnstile includes radially extending arms for pushing said paintballs around said well and radial spacers for urging said paintballs radially outwardly in said well.

6. A paintball hopper, comprising:

(a) means for containing paintballs, said means having a bottom portion;

(b) guide means at said bottom portion, adapted to permit movement of said paintballs along a set path and including a well at said bottom of said container, being defined by an inwardly facing surface that is substantially circular over an arc of about three-quarters of a circle, said inwardly facing surface thereby defining a curve, which at every point defines a tangent direction;

(c) chute means extending from said guide means disposed so that said paintballs may exit guide means to reach said chute means without a substantial change in direction; and (d) wherein said inwardly facing surface that defines said well includes a portion of relaxed curvature, and wherein said portion of relaxed curvature does not rejoin said substantially circular portion to form a closed shape, but rather partially defines an opening in said well-defining inwardly facing surface, which is the entrance to said chute means and wherein said tangent direction of said curve of said inwardly facing surface, over a path of a paintball traveling along said inwardly facing surface, varies over said path, and undergoes no discontinuities over said path.

7. The paintball hopper of claim 6 wherein said portion of relaxed curvature more specifically forms a portion of said paintball track that is straight and is joined tangentially to said substantially circular arc.

8. The paintball hopper of claim 6 wherein said inwardly facing surface curves vertically inwardly to form a concave surface, thereby forming a partial overhang that protects balls in said well from being impeded by interference from balls above said well.

9. The paintball hopper of claim 6, wherein said paintball moving assembly is a turnstile rotated by a motor assembly.

10. The paintball hopper of claim 6, wherein said turnstile includes radially extending arms for pushing said paintballs around said well and radial spacers for urging said paintballs radially outwardly in said well.

11. A paintball hopper, comprising:

(a) a container having a bottom paintball well defined by an inwardly-facing surface that is substantially circular for an arc of about three-quarters of a circle;

(b) a rotatable element, adapted to push paintballs about said paintball well;

(c) a chute leading from said paintball well; and (d) wherein said well-defining inwardly facing surface curves inwardly towards its top, thereby protecting paintballs in said well from interfering contact with paintballs above said well.

12. The paintball hopper of claim 11, wherein said rotatable element includes radial spacers, adapted to push said paintballs radially outwardly in said well.

13. A paintball hopper, comprising:

(a) a container defining a bottom paintball well having an inwardly-facing surface that is substantially circular for an arc of about three-quarters of a circle, said inwardly facing surface thereby defining a curve, which at every point defines a tangent direction;

(b) a rotatable element, adapted to push paintballs about said paintball well;

(c) a chute leading from said paintball well; and;

(d) wherein said chute is, in part, defined by an opening in said inwardly facing surface, said inwardly facing surface being flattened, relative to its generally circular shape, on one side of said chute, and wherein said change to said tangent direction of said curve of said inwardly facing surface, over a path of a paintball traveling along said inwardly facing surface, varies over said path, and undergoes no discontinuities over said path.

* * * * *